United States Patent [19]

Morrow

[11] 4,190,200

[45] Feb. 26, 1980

[54] RAIL CLIP ASSEMBLY

[75] Inventor: Warren P. Morrow, Silver Spring, Md.

[73] Assignee: Scotco, Inc., Silver Spring, Md.

[21] Appl. No.: 887,781

[22] Filed: Mar. 17, 1978

[51] Int. Cl.[2] ..... E01B 9/48

[52] U.S. Cl. ..... 238/349; 238/338

[58] Field of Search ..... 238/349, 310, 315, 338

[56] References Cited

U.S. PATENT DOCUMENTS

| | | | |
|---|---|---|---|
| 1,109,001 | 9/1914 | Loomis | 238/349 X |
| 2,162,365 | 6/1939 | Willard | 238/349 |
| 2,816,715 | 12/1957 | Gronn | 238/349 |
| 3,558,050 | 1/1971 | Sonneville | 238/349 |
| 3,576,293 | 4/1971 | Landis et al. | 238/310 X |
| 3,658,246 | 4/1972 | Davies | 238/349 |
| 3,784,097 | 1/1974 | Landis | 238/310 |
| 3,910,493 | 10/1975 | Wood | 238/349 |

FOREIGN PATENT DOCUMENTS

| | | | |
|---|---|---|---|
| 354801 | 7/1961 | Switzerland | 238/349 |
| 832872 | 4/1960 | United Kingdom | 238/349 |
| 1519875 | 8/1978 | United Kingdom | 238/349 |

*Primary Examiner*—Randolph A. Reese

*Attorney, Agent, or Firm*—Snider, Sterne & Saidman

[57] ABSTRACT

An improved rail clip and support assembly therefor which, in essence, locks the rail clip against longitudinal movement. A locking member is added to one end of a conventional rail clip fastener and, in a preferred form, comprises a downwardly extending end portion adapted to be guided into an aperture formed in the underlying support. A ramp may be provided in the aperture for facilitating removal of the locking end. Alternatively, the rail clip design may incorporate a looped portion for receiving a removal tool to facilitate separation of the clip from its support.

12 Claims, 9 Drawing Figures

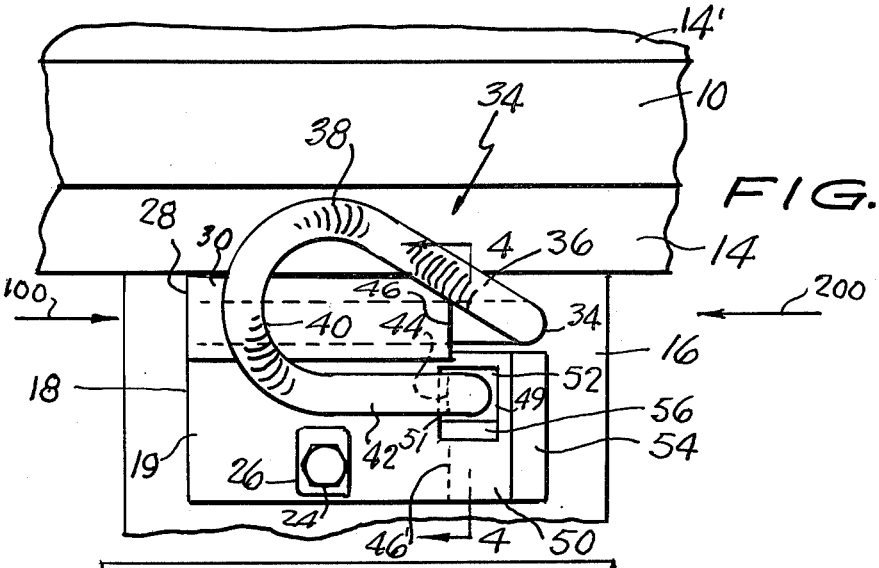
FIG. 1.
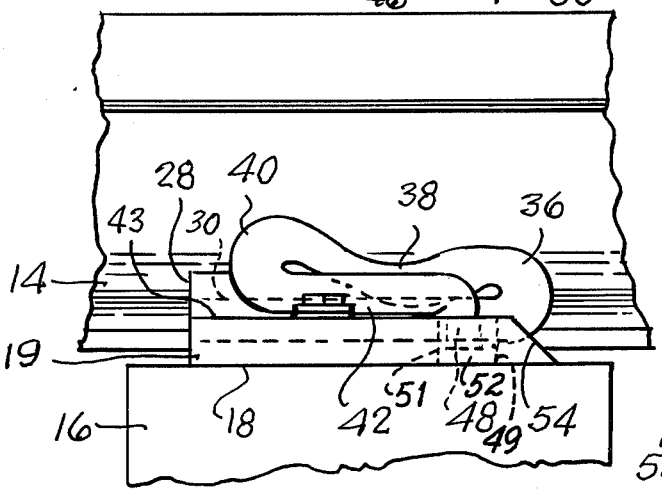
FIG. 2.
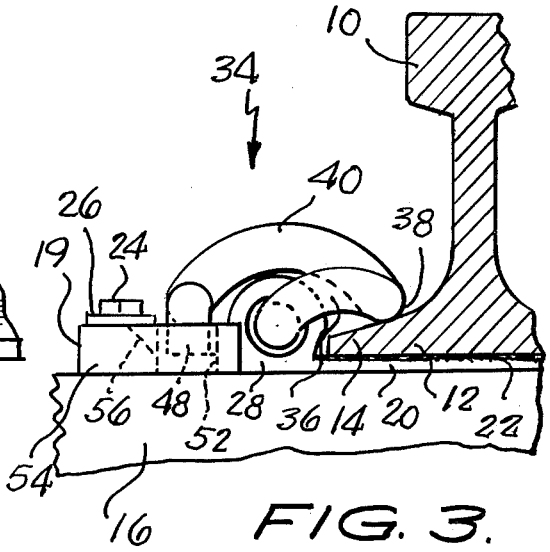
FIG. 3.
FIG. 4.
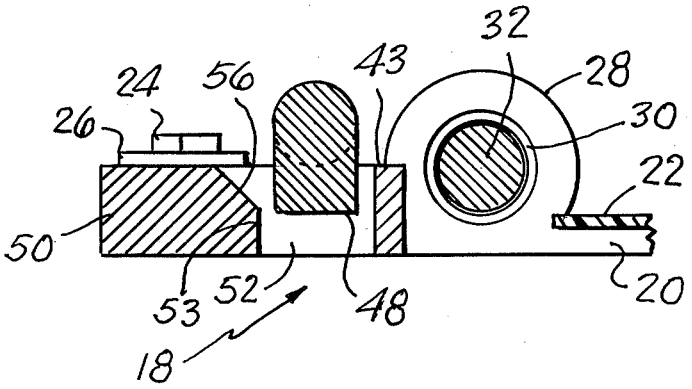

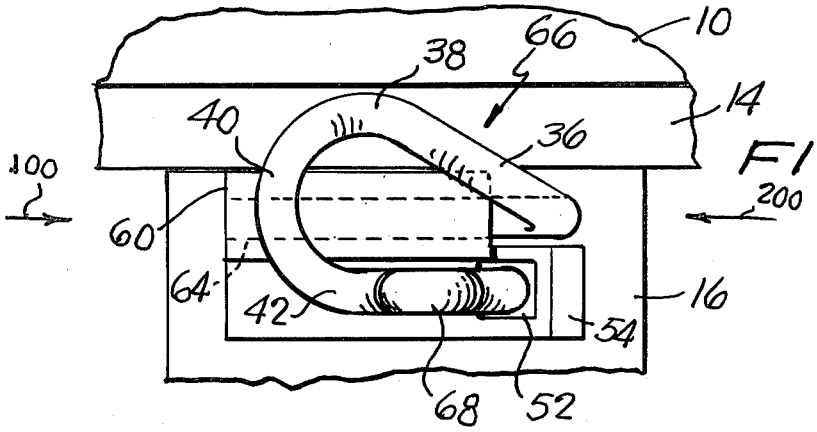
FIG. 5.
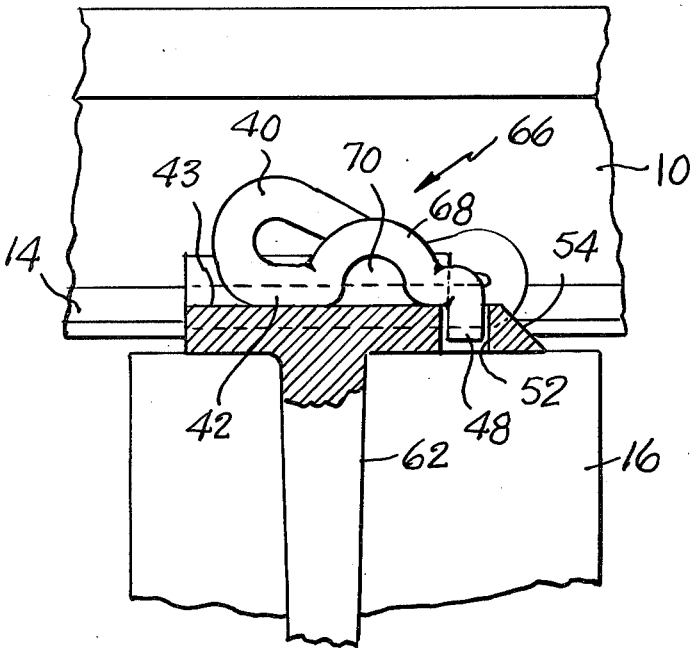
FIG. 6.
FIG. 7.
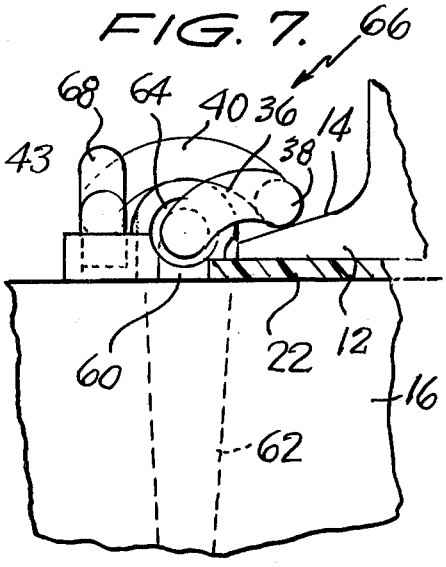
FIG. 8.
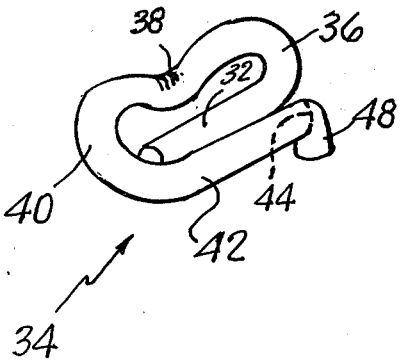
FIG. 9.
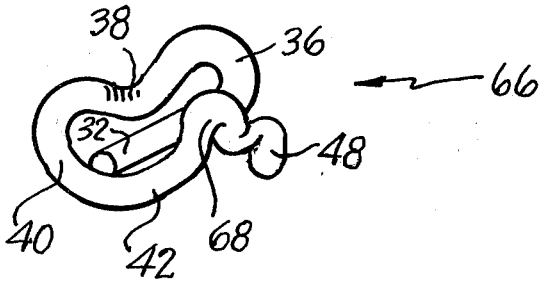

RAIL CLIP ASSEMBLY

BACKGROUND OF THE INVENTION

1. Field of the Invention

The present invention is related to railway rails and, more particularly, is directed towards a new and improved clip for fastening a railway rail to its underlying support.

2. Description of the Prior Art

Many systems have been suggested for directly fastening railway rails to their underlying support structures. With the advent and ever-increasing popularity of modern subway rail systems, the deficiencies of presently utilized rail fastening systems become increasingly apparent, as does the need for a new and improved system to overcome such deficiencies.

One of the more widely utilized rail fastening systems employs a rail clip in the form of a spring steel rod, usually of circular cross-section, which has a first end anchored in an elongated tubular shoulder positioned adjacent the rail. From this end, the rail clip is bent in a convoluted fashion so as to bear against and thereby secure the lower flange of the rail against its underlying support. The clip terminates in an elongated end substantially parallel to the first end and which rests adjacent the tubular shoulder. The clip is installed by longitudinally inserting the first end into the tubular shoulder until the convoluted portion bears properly against the flange. Insulators, spacers, resilient pads and other equipment may be utilized as necessary to provide the desired resiliency, electrical isolation, and the like. Rail clips of this nature are manufactured, for example, by Pandrol Limited of London, England, while a typical fastening and underlying support system therefor is manufactured by, for example, Landis Rail Fastening Systems, Inc. of Los Altos, California.

One problem with the Pandrol type of clip described above has been that, after installation, it provides insufficient resistance to longitudinal movement such that the clips are relatively easy prey for removal by vandals. While their transverse movement (i.e., movement transverse to the axis of the rail) is limited by the anchoring tubular shoulder, there is no similar structure to limit their longitudinal movement (i.e., movement parallel to the rail axis). A person desiring to remove such a clip need only apply sufficient force in a longitudinal direction to remove the first end from the tubular shoulder.

Such a low resistance to longitudinally applied forces presents a potentially hazardous situation in that a loose wheel on the train, or other protrusion from a rail car, could easily dislodge a clip upon impact, thereby loosening the rail and creating a substantial safety hazard.

Additionally, a train moving over the rail imparts a standing wave thereto such that, over a period of time, the vibrational forces resulting from repeated standing waves tend to loosen the clips from their supports, thereby creating another hazard.

A further disadvantage with respect to the prior art rail clips described above is that it is difficult for a workman to judge when the clip is properly fully inserted into its support. There is no positive means for locking same in its fully installed position.

Prior art patents in this general area of which I am aware include: U.S. Pat. Nos. 1,109,001; 2,816,715; 3,558,050; 3,576,293; 3,658,246; 3,784,097; 3,910,493; and British No. 832,872.

OBJECTS AND SUMMARY OF THE INVENTION

It is therefore a primary object of the present invention to provide a new and improved rail clip and assembly therefor which overcomes all of the disadvantages noted above with respect to prior art systems and assemblies.

Another object of the present invention is to provide a new and improved rail clip for securing a railway rail to an underlying support which provides positive locking against longitudinal movement.

A further object of the present invention is to provide a new and improved rail clip for a railway rail fastening system which is inexpensive to manufacture, easy to install, easy to remove with proper tools, and is more vandal-proof and accident resistant than prior art designs.

A still further object of the present invention is to provide an improved rail clip for a rail fastener system which incorporates all of the advantages of the prior art designs and yet provides improved performance features thereover at minimal additional cost.

The foregoing and other objects are attained in accordance with one aspect of the present invention through the provision of a rail clip for fastening a longitudinally extending railway rail to an underlying support, which comprises a single rod having a first end portion, a second end portion and a bent portion intermediate the first and second end portions which is adapted to contact and thereby retain the rail against the underlying support. The first end portion comprises a first elongated end portion positioned in use substantially parallel to the longitudinally extending rail. The second end portion comprises a second elongated end portion parallel to the first elongated end portion. Means are provided which extend integrally from the second elongated end portion for locking the rod against longitudinal movement.

In accordance with more specific aspects of the present invention, the locking means comprises a terminal portion extending downwardly from the second elongated end portion. The terminal portion is preferably formed at a substantially right angle with respect to the second elongated end portion and defines a terminating end of the rod.

The underlying support comprises a tubular shoulder which is adapted to receive the first elongated end portion of the rod, and an end section which extends laterally from the shoulder and includes a substantially planar top surface upon which the second elongated end portion lies. In accordance with other aspects of the present invention, the end section of the support includes keeper means for receiving the locking means. The keeper means in a best mode comprises an aperture which extends downwardly from the top surface of the end section, which aperture preferably includes means formed adjacent thereto for facilitating removal of the locking means therefrom after installation. The removal facilitating means more particularly comprises an inclined ramp which extends from the top surface to the aperture. In accordance with other aspects of the present invention, the end section further includes means for facilitating installation of the locking means into the aperture. In a preferred embodiment, the installation facilitating means comprises ramp means positioned at the forward portion of the end section for raising the downwardly extending locking end up to the planar top surface of the end section as the first elongated end portion of the rod is being inserted in the tubular shoulder. The ramp means is formed in the forward edge of the end section and the plane thereof makes an acute angle with respect to the horizontal.

As an alternative to the ramp in the aperture, the second elongated end portion may include a loop portion integrally formed in the rod adjacent the locking end for facilitating removal of the rod from the underlying support. The loop portion more particularly may comprise an inverted, substantially U-shaped portion which is adapted to receive a removal tool therein.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a top, plan view which illustrates a preferred embodiment of the rail clip and installation assembly of the present invention;

FIG. 2 is a side view in elevation of the preferred embodiment illustrated in FIG. 1;

FIG. 3 is a front view in elevation of the preferred embodiment illustrated in FIG. 2;

FIG. 4 is an enlarged, sectional view of the preferred embodiment illustrated in FIG. 1 and taken along line 4—4 thereof;

FIG. 5 is a top, plan view which illustrates an alternate preferred embodiment of the rail clip and assembly therefor of the present invention;

FIG. 6 is a side, partly sectional view of the alternate preferred embodiment illustrated in FIG. 5;

FIG. 7 is a front view in elevation of the alternate embodiment illustrated in FIG. 6;

FIG. 8 is a perspective view illustrating the first preferred embodiment of the rail clip of the present invention; and FIG. 9 is a perspective view which illustrates the second and alternative embodiment of the rail clip of the present invention.

DETAILED DESCRIPTION OF THE PREFERRED EMBODIMENTS

Referring now to the drawings, wherein like reference numerals represent identical or corresponding parts throughout the several views, and more particularly to FIGS. 1 through 3 thereof, there is illustrated a first preferred embodiment of a rail clip and assembly therefor of the present invention.

Reference numeral 10 indicates a standard railway rail having a broad base flange 12 which extends laterally along both sides of rail 10 at the lower portion thereof. The base flange 12 includes an upper inclined surface 14 against which the rail clip of the present invention, indicated generally by reference numeral 34, is adapted to contact to hold the rail 10 in place.

For the sake of simplicity and ease in explanation, the present invention will be described and illustrated in connection with one of the lateral side flanges 12 of the rail 10, since an identical structure may be utilized in connection with the other parallel flange having an inclined surface 14' (FIG. 1).

In the embodiment illustrated in FIGS. 1 through 3, reference numeral 16 indicates an underlying support structure which may be, for example, a prestressed concrete crosstie, slab, or the like, upon which the rail clip and assembly of the present invention is adapted to be installed.

The rail clip assembly in this embodiment comprises a base plate structure 18 which includes a center portion 20 which extends under the base flange 12 of rail 10 and terminates on both sides thereof in an end portion 19. As pointed out hereinabove, only one such end portion 19 is illustrated for the sake of simplicity and ease in understanding, since it will be clear to a person skilled in this art that an identical end portion may be formed on the other side of the rail 10 integrally from the central portion 20.

Preferably positioned between the base flange 12 and the center portion 20 of the base plate structure 18 is an elastomer layer 22 for providing vibration damping and electrical insulation between the flange 12 and the center portion 20.

The base plate structure 18 may be fastened to the supporting structure 16 by any of a number of conventional, known techniques. For example, a bolt 24 may be positioned through each end portion 19, and an insulating washer 26 or the like may be interposed between the bolt 24 and the end portion 19. The manner of attaching the bolt 24 through the base plate structure 18 to the supporting slab 16 may be, for example, as described in U.S. Pat. Nos. 3,576,293 or 3,784,097, both of which are assigned to the Landis Sales Company of Los Altos, California. Such details are conventional and form no part of the present invention.

Between the end portion 19 and the center portion 20 of the base plate structure 18 is located an integrally formed shoulder member 28 which defines a longitudinally extending, substantially cylindrical aperture 30. Aperture 30 is adapted to receive a similarly sized elongated end portion 32 of the rail clip indicated generally by reference numeral 34.

The rail clip 34 of the present invention is preferably constructed of heat treated spring steel and is preferably, although not necessarily, of uniform substantially circular cross-section along its entire length.

The rail clip 34, illustrated in a perspective view in FIG. 8, consists of a single piece of rod which is shaped and bent from one end to the other so as to retain the base flange portion 12 of the railway rail 10 against the base plate structure 18 and, in turn, against the underlying slab 16. The rail clip 34 includes, as pointed out above, an elongated end portion 32 adapted to fit within the aperture 30 in shoulder member 28. A curved portion 36 extends laterally and rearwardly from the elongated end portion 32 to the top surface 14 of flange 12 where it contacts same at a contact portion indicated generally by reference numeral 38. It may be desirable to interpose an insulator (not shown) between the contact portion 38 of rail clip 34 and the upper surface 14 of flange 12 to ensure electrical isolation of the rail 10.

From the contact portion 38, the rail clip 34 extends in a curved portion 40 which extends over the first elongated end portion 32 back towards the end portion 19 of the base plate structure 18. Extending from the curved portion 40 is a second elongated end portion 42 which is substantially parallel to the first elongated end portion 32 and which rests adjacent the upper surface 43 of the end portion 19 of the base plate structure 18.

The portions of the rail clip 34 thus far described, i.e., elongated end portion 32, curved portion 36, contact portion 38, curved portion 40 and elongated end portion 42, constitute a previously known design and is acknowledged prior art with respect to the present invention. More particularly, the end portion 42 of the prior art rail clip terminates at the location indicated by the dotted line 44 (FIGS. 1 and 8). The terminal end 44 of the prior art rail clip is substantially colinear with the forward edge 46 of the prior art base plate. The forward terminating edge of the end section of the prior art base plate is indicated in FIG. 1 by the dotted line 46'.

As may be apparent from a consideration of FIG. 1, termination of the prior art rail clip at the terminal end 44 provides precious little resistance to forces applied in the direction indicated by arrow 100. The rail clip of the prior art is therefore subject to displacement from the aperture 30 of tubular member 28 by vandals, protrusions from railway cars such as loose wheels, vibrational forces imparted by trains, or the like.

As a solution to the foregoing problems, the improved rail clip 34 of the present invention provides a terminal or locking portion 48 which extends integrally and downwardly from the longitudinal portion 42 and, in a preferred mode, is at approximately a right angle with respect thereto.

The end portion 19 of base plate structure 18 is also modified according to the present invention by providing a forward extended portion 50 in which is formed a keeper 52 for locking portion 48. Keeper 52 is in the form of a downwardly extending aperture which is closed on all sides in order to inhibit any transverse or longitudinal movement of locking portion 48 of clip 34, once positioned within keeper 52.

To facilitate installation of the rail clip 34, the forward edge of extension 50 is inclined to form a ramp 54. Ramp 54 preferably makes an acute angle with respect to the horizontal, and is inclined so as to raise the locking portion 48 to the level of the upper surface 43 of end portion 19 as the elongated end portion 32 of clip 34 is inserted into aperture 30 of shoulder member 28, along the direction indicated by reference arrow 200 in FIG. 1.

While the front and rear walls 49 and 51, respectively, of keeper aperture 52 prevent movement of the rail clip 34 in the directions respectively indicated by arrows 100 and 200, one of the side walls 53 may include an upper inclined portion 56 (see FIG. 4) for facilitating insertion of a tool underneath locking portion 48 to assist in removing the clip 34 from its supporting structure.

In order to remove clip 34, a removal tool must be inserted underneath locking portion 48 via ramp 56 to pull end 48 upwardly. Once end 48 is above the upper surface 43 of end portion 19, a force must then be applied along the direction indicated by arrow 100 in order to remove the first end 32 from aperture 30. The requirement for some type of removal tool, in addition to the necessity of applying a force in two directions, renders the clip 34 of the present invention substantially more tamper-proof, vandal-proof and resistant to accidental dislodging from the base plate structure.

Another benefit afforded by the present invention is that insertion of the locking portion 48 in its keeper 52 provides a positive installation indication, so that the installer is assured that the clip 34 is properly seated.

FIGS. 5 through 7 and 9 illustrate an alternate embodiment of the present invention in the form of a rail clip 66. The rail clip 66 is illustrated in FIGS. 5 through 7 as installed in a slightly different type of rail fastening installation wherein the base plate structure 18 of FIGS. 1 through 4 has been replaced in favor of a shoulder member 60 having a downwardly extending spike 62 for retaining same in the crosstie 16. The shoulder member 60 still includes a longitudinal aperture 64 for retaining the first elongated end portion 32 of the clip 66.

As may be appreciated by a comparison of FIGS. 8 and 9, the clip 66 is substantially identical to clip 34, with the exception of the provision in the former of a loop portion 68 in the second elongated end portion 42. The loop portion 68 is located approximately adjacent the locking portion 48 and forms, as may be seen in FIG. 6, an opening 70 in which a tool may be inserted to facilitate the removal of rail clip 66. Thus, the loop portion 68 provides an alternative to providing the keeper aperture 52 with a side ramp 56. The two rail clips 34 and 66 are similar in all other respects, and it is clear to a person of ordinary skill in the art that either clip 34 or clip 66 may be utilized on either of the two types of rail fastening systems indicated in FIGS. 1 through 4 or 5 through 7, or any other type of system.

In operation of the embodiment of FIGS. 5 through 7, the clip 66 is installed by inserting end 32 within longitudinal aperture 64 of shoulder member 60. Locking portion 48 is guided up the forwardly positioned ramp 54 until the former drops within keeper slot 52. Upon removal, a tool may be inserted in opening 70 to raise locking portion 48 above the upper surface 43, whereupon the clip 66 may be moved in the direction indicated in FIG. 5 by arrow 100.

Obviously, numerous modifications and variations of the present invention are possible in light of the above teachings. It is therefore to be understood that within the scope of the appended claims, the invention may be practiced otherwise than as specifically described herein.

I claim as my invention:

1. A rail clip for fastening a longitudinally extending railway rail to an underlying support, which comprises:

a single rod having a first end portion, a second end portion and a bent portion intermediate said first and second end portions adapted to contact and thereby retain said rail against said support, said first end portion comprising a first elongated end portion positioned in use substantially parallel to said longitudinally extending rail, said second end portion comprising a second elongated end portion parallel to said first elongated end portion and means extending integrally from said second elongated end portion for locking said rod against longitudinal movement wherein said locking means comprises a unitarily formed terminal portion extending downwardly from said second elongated end portion, wherein said terminal portion is formed at a substantially right angle to and has substantially the same diameter as said second elongated end portion, and wherein said terminal portion defines the terminating end of said second end portion of said rod.

2. A rail clip for fastening a longitudinally extending railway rail to an underlying support, which comprises:

a single rod having a first end portion, a second end portion and a bent portion intermediate said first and second end portions adapted to contact and thereby retain said rail against said support, said first end portion comprising a first elongated end portion positioned in use substantially parallel to said longitudinally extending rail, said second end portion comprising a second elongated end portion parallel to said first elongated end portion and means extending integrally from said second elongated end portion for locking said rod against longitudinal movement, wherein said second elongated end portion further includes means for facilitating removal thereof from said underlying support, wherein said removal facilitating means comprises a loop portion integrally formed in said rod adjacent said locking means.

3. The rail clip as set forth in claim 2, wherein said loop portion comprises an inverted, substantially U-shaped portion adapted to receive a removal tool therein.

4. A rail clip for fastening a longitudinally extending railway rail to an underlying support, which comprises:

a single rod having a first end portion, a second end portion and a bent portion intermediate said first and second end portions adapted to contact and thereby retain said rail against said support, said first end portion comprising a first elongated end portion positioned in use substantially parallel to said longitudinally extending rail, said second end portion comprising a second elongated end portion parallel to said first elongated end portion and means extending integrally from said second elongated end portion for locking said rod against longitudinal movement, further in combination with said underlying support which comprises a tubular shoulder adapted to receive said first elongated end portion of said rod, and an end section extending laterally from said shoulder and including a substantially planar top surface upon which said second elongated end portion lies, wherein said end section of said support includes keeper means for receiving said locking means, wherein said keeper means comprises an aperture extending downwardly from said top surface of said end section, and wherein said aperture includes means formed adjacent thereto for facilitating removal of said locking means therefrom, wherein said removal facilitating means comprises an inclined ramp extending from said top surface to said aperture.

5. The rail clip as set forth in claims 2 or 4, wherein said locking means comprises a terminal portion extending downwardly from said second elongated end portion.

6. The rail clip as set forth in claim 5, wherein said terminal portion is formed at a substantially right angle with respect to said second elongated end portion.

7. The rail clip as set forth in claim 5, wherein said terminal portion defines a terminating end of said rod.

8. A rail clip for fastening a longitudinally extending railway rail to an underlying support, which comprises:

a single rod having a first end portion, a second end portion and a bent portion intermediate said first and second end portions adapted to contact and thereby retain said rail against said support, said first end portion comprising a first elongated end portion positioned in use substantially parallel to said longitudinally extending rail, said second end portion comprising a second elongated end portion parallel to said first elongated end portion and means extending integrally from said second elongated end portion for locking said rod against longitudinal movement, further in combination with said underlying support which comprises a tubular shoulder adapted to receive said first elongated end portion of said rod, and an end section extending laterally from said shoulder and including a substantially planar top surface upon which said second elongated end portion lies, wherein said end section of said support includes keeper means for receiving said locking means, wherein said keeper means comprises an aperture extending downwardly from said top surface of said end section, and wherein said end section further includes means for facilitating installation of said locking means into said aperture, wherein said installation facilitating means comprises ramp means positioned at the forward portion of said end section for raising said locking means up to said planar top surface of said end section as said first elongated end portion of said rod is being inserted in said tubular shoulder, and wherein said locking means comprises a terminal portion extending downwardly from said second elongated end portion, wherein said terminal portion is formed at a substantially right angle with respect to said second elongated end portion.

9. The rail clip as set forth in claim 8, wherein said ramp means is formed in the forward edge of said end section and the plane thereof makes an acute angle with respect to the horizontal.

10. The rail clip as set forth in claim 8, wherein said second elongated end portion further includes means for facilitating removal thereof from said underlying support.

11. The rail clip as set forth in claim 10, wherein said removal facilitating means comprises a loop portion integrally formed in said rod adjacent said locking means.

12. The rail clip as set forth in claim 11, wherein said loop portion comprises an inverted, substantially U-shaped portion adapted to receive a removal tool therein.

* * * * *